US009851104B2

(12) United States Patent
Damiani et al.

(10) Patent No.: US 9,851,104 B2
(45) **Date of Patent: *Dec. 26, 2017**

(54) LIGHTING APPARATUS FOR TOBACCO-BASED PRODUCTS

(71) Applicants: Teresa R. Damiani, Hinckley, OH (US); Bruce A. Zaccagnini, Hinckley, OH (US); James C. Cutri, Alexandria, VA (US)

(72) Inventors: Teresa R. Damiani, Hinckley, OH (US); Bruce A. Zaccagnini, Hinckley, OH (US); James C. Cutri, Alexandria, VA (US)

( * ) Notice: Subject to any disclaimer, the term of this patent is extended or adjusted under 35 U.S.C. 154(b) by 659 days.

This patent is subject to a terminal disclaimer.

(21) Appl. No.: 14/486,045

(22) Filed: Sep. 15, 2014

(65) Prior Publication Data

US 2016/0076770 A1 Mar. 17, 2016

(51) Int. Cl.

| | |
|---|---|
| ***A24D 1/08*** | (2006.01) |
| ***F23Q 1/06*** | (2006.01) |
| ***A24F 15/18*** | (2006.01) |

(52) U.S. Cl.

CPC ..... *F23Q 1/06* (2013.01); *A24D 1/08* (2013.01); *A24F 15/18* (2013.01)

(58) Field of Classification Search

CPC ..... A24D 1/08; A24F 15/18; B65D 85/109; F23Q 1/06

USPC ..... 206/85–95; 221/136–42

See application file for complete search history.

(56) References Cited

U.S. PATENT DOCUMENTS

| | | | |
|---|---|---|---|
| 1,529,181 | A | 3/1925 | Holmes |
| 1,835,928 | A | 12/1931 | Boillot |
| 1,971,203 | A | 8/1934 | Soltys |
| 2,006,591 | A | 7/1935 | Fox |

(Continued)

FOREIGN PATENT DOCUMENTS

| | | | |
|---|---|---|---|
| CH | 677720 | A5 | 6/1991 |
| JP | 11-178563 | A | 7/1999 |

(Continued)

OTHER PUBLICATIONS

International Search Report and Written Opinion of International Application No. PCT/US2014/019208 mailed Jun. 2, 2014 (7 pages).

(Continued)

*Primary Examiner* — Eric Yaary

(74) *Attorney, Agent, or Firm* — Taft Stettinius & Hollister LLP; Ryan O. White

(57) ABSTRACT

An igniter apparatus for igniting a tobacco-based product having a sensitized tip. The igniter apparatus includes a first member and a second member cooperatively defining a chamber having sides supporting an abrasive. The first member and second member are biased at a first position with a bias element and movement of the first member toward the second member compresses the bias element, reduces the size of the chamber, and thereby decreases the distance between the abrasives located at the side of the chamber. Insertion of the tobacco based product in the first position locates the sensitized tip adjacent to the abrasives. Compression of the bias element reduces the size of the chamber such that the sensitized tip contacts the abrasive. Removal of the tobacco-based product from the reduced-in-size chamber ignites the sensitized tip, thereby lighting the tobacco-based product for smoking.

9 Claims, 6 Drawing Sheets

(56) References Cited

U.S. PATENT DOCUMENTS

| | | | |
|---|---|---|---|
| 2,445,317 | A | 7/1948 | Montague |
| 2,803,376 | A | 8/1957 | Kampff |
| 2,997,045 | A | 8/1961 | Karapff |
| 3,136,318 | A | 6/1964 | Nakamura |
| 3,359,987 | A | 12/1967 | Ishii |
| 3,046,995 | A | 7/1968 | Christy |
| 4,164,999 | A | 8/1979 | Tsukamoto |
| 4,310,007 | A | 1/1982 | Auersbacher |
| 4,342,902 | A | 8/1982 | Ping |
| 4,491,139 | A | 1/1985 | Weinert |
| 4,570,645 | A | 2/1986 | Newman et al. |
| 4,621,649 | A | 11/1986 | Osterrath |
| 4,694,841 | A | 9/1987 | Eparza |
| 4,795,027 | A | 1/1989 | Benavides |
| 5,388,594 | A | 2/1995 | Counts et al. |
| 2,652,060 | A1 | 9/2015 | Shio |
| 2003/0205487 | A1 | 11/2003 | Lin |
| 2007/0228059 | A1 | 10/2007 | Karsan |
| 2007/0272566 | A1 | 11/2007 | Divers |
| 2010/0264157 | A1 | 10/2010 | Bailey et al. |

FOREIGN PATENT DOCUMENTS

| | | | |
|---|---|---|---|
| JP | 2012-097968 | A | 5/2012 |
| KR | 20-0272745 | | 4/2002 |
| KR | 200461620 | Y1 | 7/2012 |
| WO | 02-065863 | A1 | 8/2002 |
| WO | 02-072745 | A1 | 9/2002 |

OTHER PUBLICATIONS

Pending U.S. Appl. No. 13/804,378, Lighting Apparatus for Tobacco-Based Products, to Damiani et al., filed Mar. 14, 2013.

International Search Report and Written Opinion of International Application No. PCT2014/055603, mailed Jun. 15, 2015.

International Preliminary Report on Patentability of International Application PCT/US2014/019208 issued Sep. 15, 2015 (5 pages).

LIGHTING APPARATUS FOR TOBACCO-BASED PRODUCTS

FIELD

The present disclosure relates to a lighting apparatus and more particularly a lighting apparatus used to ignite tobacco-based products having a sensitized tip.

BACKGROUND

The statements in this section merely provide background information related to the present disclosure and should not be construed as constituting prior art.

The production of tobacco-based products (cigarettes) has become a major industry with many consumers routinely purchasing and consuming these products. Tobacco products require an ignition source for the consumer to effectively smoke the tobacco-based contents. Consumers currently use many different methods for lighting these products.

Gas lighters, electrical lighters, and matches are all commonly used to ignite the tobacco within these products. The large consumer base for tobacco-based products has necessarily generated a large consumer base for the ignition sources as well.

There are several flaws in current ignition sources. The gas lighter is often made of plastic or metal and must maintain the appropriate amount of fuel to be effective. Gas lighters often do not maintain the appropriate flame when used in windy or rainy conditions. Once the fuel runs out, the lighter is either discarded or refilled. The gas lighter also requires significant vital resources to produce and to operate. Further, the use and disposal of the lighter creates significant negative impacts upon the environment.

Using a match as an ignition source for tobacco-based products has many undesirable effects as well. Matches are sensitive to the surrounding environment, and often cannot be used if the matches are wet or used in a windy area. The user is also limited to a set number of matches, and once the last match is used, the user will have no ignition means for lighting the tobacco-based products.

Electronic lighters can be very effective, and reusable, but usually require a bulky battery or frequent recharge to generate enough energy to ignite tobacco. The electronic lighters can also be adversely affected by water. Further, improper disposal of a portable electronic lighter can introduce harmful battery acid into the environment.

The users of tobacco based products are inconvenienced and potentially endangered by relying upon these separate ignition sources. Lighters and matches can be maintained in a relatively small compartment that can be easily lost or misplaced. Further, the misuse of these products is inherently dangerous for the consumer. Misused ignition sources frequently cause accidental fires. The propensity of matches and lighters to be misplaced significantly increases the chances that a minor will obtain and negligently misuse the product possibly resulting in severe harm.

Finally, tobacco-based products can be manufactured with a sensitized tip that enables ignition by striking the tip against an abrasive material. This uniquely couples the ignition source to the tobacco itself. Past designs utilize strike pads on the side of a pack holding the tobacco-based product. Similar to lighting a match, the sensitized tip is dragged down the strike pad to create enough friction to ignite the tip. Lighting the tobacco-based product by striking it against the strike pad creates difficulties because the product can easily be broken when attempting to ignite the tip and the strike pad can lose the abrasive qualities necessary to ignite the tip.

What is needed is an improved design for facilitating the lighting of a tobacco-based product. The present application is intended to improve upon and resolve some of these known deficiencies of the art.

SUMMARY

In accordance with one aspect of the present disclosure, there is provided an igniter apparatus for igniting a tobacco-based product having a sensitized tip. The igniter apparatus includes a first member having a projecting portion with a cavity, and a first concave surface disposed adjacent to the projecting portion. A second member includes a rib, a receiving portion configured to receive the projecting portion, and a second concave surface disposed adjacent to the receiving portion. The cavity is configured to receive the rib and the first concave surface and the second concave surface define a chamber configured to receive the tobacco-based product when the projecting portion is located in the receiving portion and the rib is disposed in the cavity.

According to another aspect of the present disclosure, there is provided an igniter apparatus for igniting a tobacco-based product having a sensitized tip including a first member having a first concave surface. A second member includes a second concave surface, wherein: i) one of the first member and the second member is configured to slidingly engage with the other of the first member and second member; ii) one of the first member and the second member includes a rib configured to engage a cavity of the other of the first member and the second member; and iii) one of the first member and the second member and formed to include a bias element configured to engage the other of the first member and the second member.

BRIEF DESCRIPTION OF THE DRAWINGS

The above-mentioned aspects of the present application and the manner of obtaining them will become more apparent and the teachings of the present application itself will be better understood by reference to the following description of the embodiments of the present application taken in conjunction with the accompanying drawings, wherein.

Figure 1:
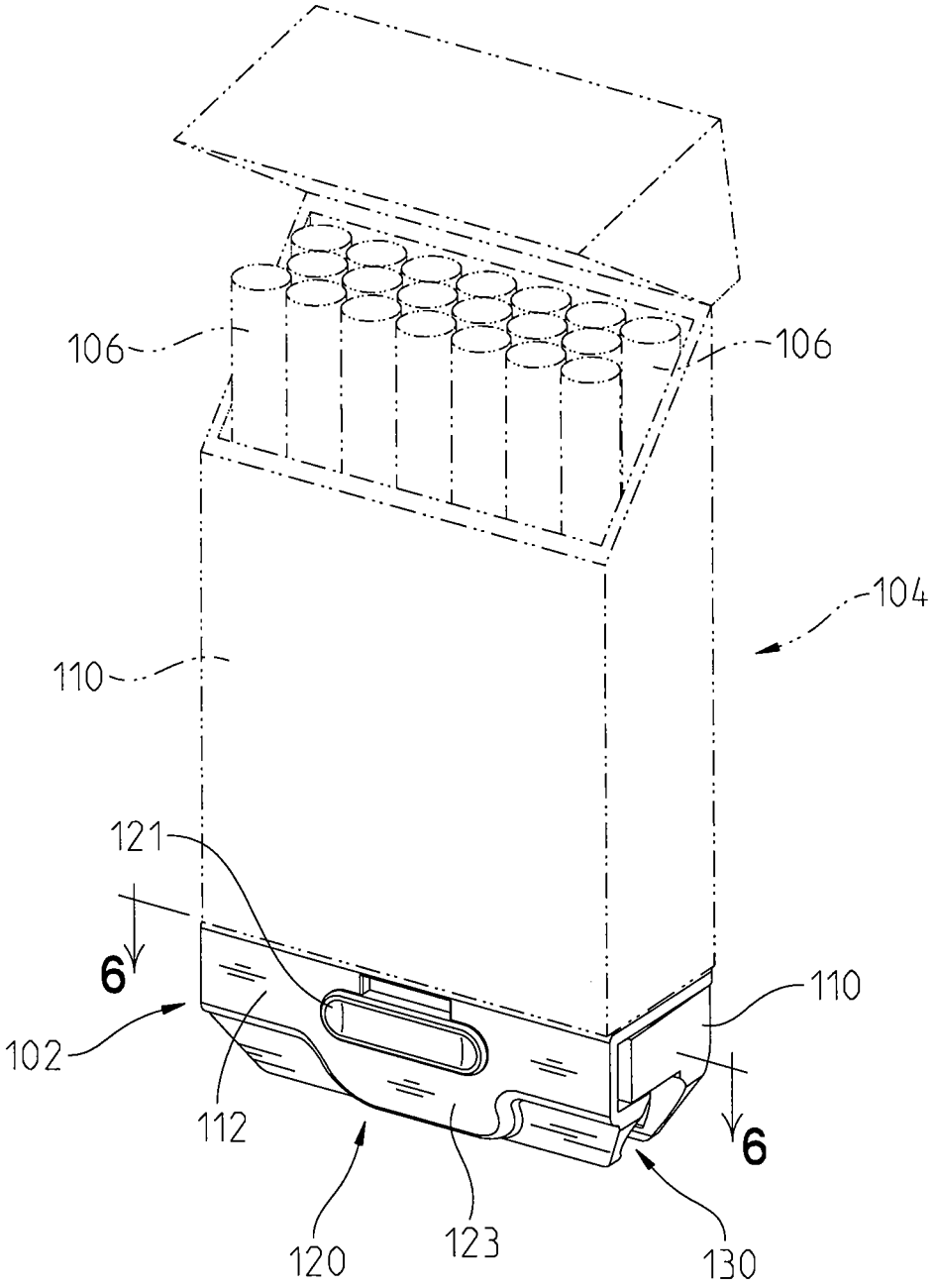
FIG. 1 is a perspective view of an igniter apparatus coupled to a pack of cigarettes.

Corresponding reference characters indicate corresponding parts throughout the several views. Although the exemplification set out herein illustrates embodiments of the present application, in several forms, the embodiments disclosed below are not intended to be exhaustive or to be construed as limiting the scope of the present application to the precise forms disclosed.

DETAILED DESCRIPTION

The embodiments of the present application described below are not intended to be exhaustive or to limit the teachings of the present application to the precise forms disclosed in the following detailed description. Rather, the embodiments are chosen and described so that others skilled in the art may appreciate and understand the principles and practices of the present application.

Unless defined otherwise, all technical and scientific terms used herein have the same meaning as commonly understood by one of ordinary skill in the art to which this application belongs. To this end, the phrase "tobacco-based product" is intended to include any tobacco product or similar product capable of igniting in accordance with the teachings of the present disclosure. This includes, but is not limited to, cigarettes and cigars. As such, those of skill in the art should understand and appreciate herein that the present teachings are intended to cover any such use of a tobacco-based product. Further, the contents of the product should not be limited to tobacco. One skilled in the art will appreciate that the disclosed embodiments could be used to ignite any product that is used similarly to tobacco. Although any method, components, parts, devices and materials similar to or equivalent to those described herein can be used in the practice or testing of the present application, the specific apparatus, methods and materials are now described.

FIG. 1 illustrates a pack of cigarettes 100 coupled to an igniter apparatus 102 to provide a kit or unit 104. In one embodiment, a top of the igniter apparatus 102 is dimensioned to be substantially similar to the bottom dimensions of the pack of cigarettes 100. This arrangement enables the unit 100 to be easily carried. Coupling the pack of cigarettes 100 with the igniter apparatus 102 provides for storage of one or more sensitized cigarettes 106 and at the same time providing the easily accessible igniter apparatus 102. While this particular embodiment shows the igniter apparatus 102 coupled to the bottom of a pack of cigarettes 100, the disclosure does not limit the igniter apparatus 102 to this embodiment in which the igniter apparatus 102 is coupled to a pack of cigarettes 100. One skilled in the art will understand how the igniter apparatus 102 is equally effective standing alone or coupled to a variety of surfaces. Further, one skilled in the art will understand that the pack of cigarettes could be replaced by a reusable and/or refillable container that is configured to hold a tobacco-based product.

Other embodiments of an igniter apparatus are described in U.S. patent application Ser. No. 13/804,378 having the title "Lighting Apparatus For Tobacco-Based Products" filed Mar. 14, 2013, the disclosure of which is incorporated by reference herein in its entirety.

Figure 2:
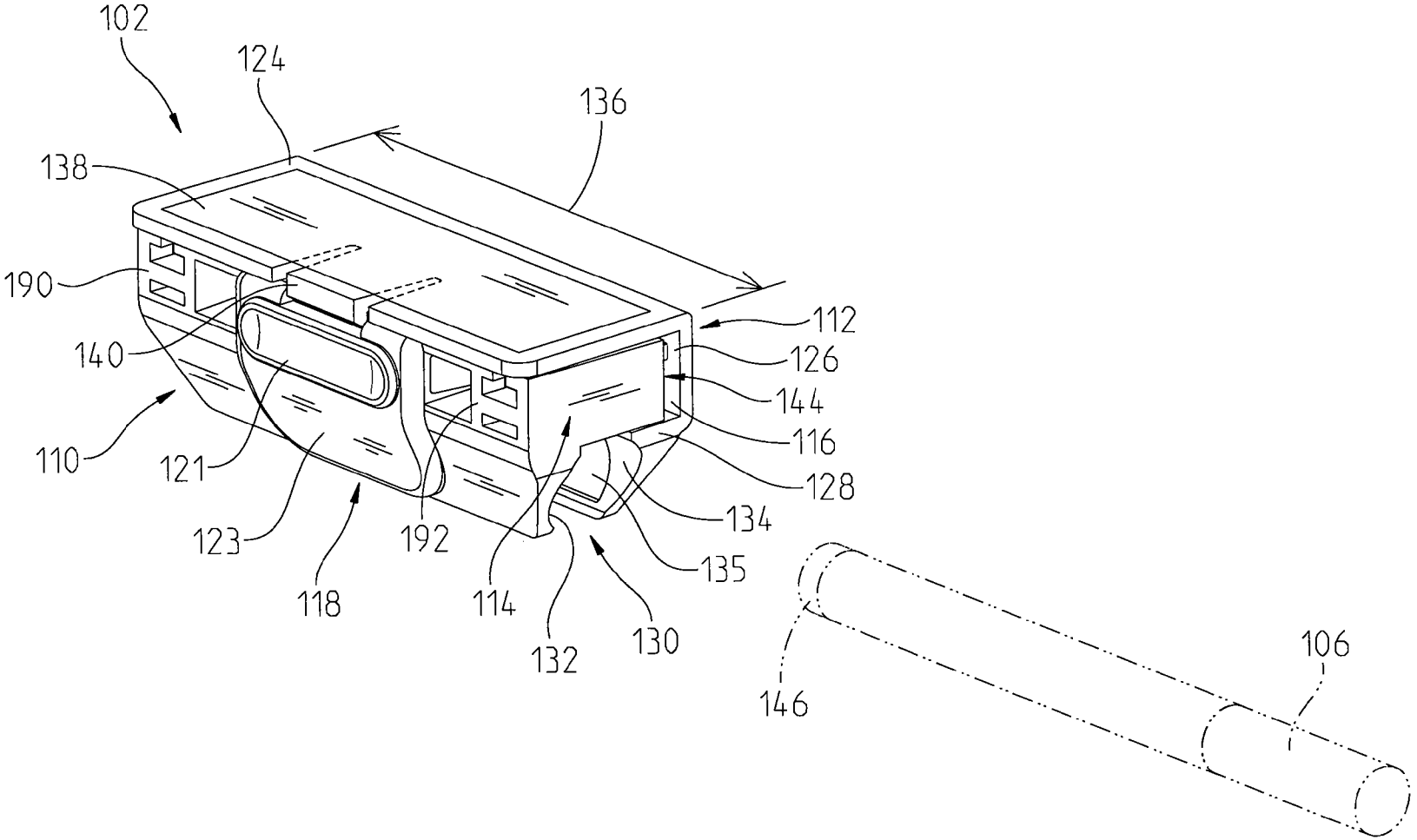
FIG. 2 is a perspective view of the igniter apparatus of FIG. 1 in an open configuration and uncoupled from the pack of cigarettes.

As further illustrated in FIG. 2, the igniter apparatus 102 includes a first member 110 and a second member 112. The first member 110 includes a projecting portion 114 configured to be located within a receiving portion 116 of the second member 112. In the illustrated embodiment, the projecting portion 114 extends from a user accessible surface 118 configured to provide a tangible interface for the hand of a user to ignite the tobacco-based product. As seen in FIG. 1, the second member 112 also includes user accessible surface 120 configured to provide a second tangible interface for the hand of a user. While the user accessible surfaces 118 and 120 are similarly configured as illustrated in FIGS. 1 and 2, other embodiments include different user accessible surfaces, including those as further illustrated and described herein.

Each of the user accessible surfaces 118 and 120 define an oblong shaped portion 121 having raised edges to provide the tactile interface for a user. The oblong portion 121 enables a user to locate the hands at a point where the application of pressure helps insure a reasonable relative movement between the first member 110 and the second member 112. A surface 123 extends away from each of the oblong portions 121 on either side of the igniter apparatus such that the surfaces 123 converge toward one another at a chamber 130.

As shown in FIG. 2, the projecting portion 114 extends from the user accessible surface 118 and into the receiving portion 116 of the second member 112. The projecting portion generally outlines a rectangular prism which fits within a space defined by the receiving portion 116 and, in particular, a top wall 124, a back wall 126, and a bottom wall 128.

Compression or movement of the first member 110 with respect to the second member 112 (or vice versa) adjusts the size of the chamber 130 which is configured to receive one of the cigarettes 106. The chamber 130 is generally cylindrical and is formed by a first concave surface 132 extending from the projecting portion 114 and a second concave surface 134 extending from the receiving portion 116. Each of the first and second concave surfaces 132 and 134 extends along a length 136 of the igniter apparatus 102, wherein the length 136 in one embodiment is similar to a dimension of the pack 100 as illustrated in FIG. 1. Each of the concave surfaces 132 and 134 defines at least a generally semi-circular outline shaped to accommodate an outside surface of the cigarette 106 in the illustrated embodiment. In other embodiments, one or more semi-circular outlines are of different sizes to accommodate different sizes of smoking products, such as cigars. In addition, one or both of the concave surfaces 132 and 134 support an abrasive 135. The abrasive 135, in different embodiments is an abrasive strip which is glued, taped, or adhered to the concave surface. In another embodiment, the abrasive is a sprayable or brushed on adhesive which sticks to or dries at the surface to provide an abrasive coating. In still another embodiment, the abrasive is formed as a part of the concave surfaces 132 and 134.

In other embodiments, the abrasive coating is composed of red phosphorus, powdered glass, and an adhesive which when combined sufficiently ignite the sensitized tip of the cigarette. One skilled in the art will understand in other embodiments, the materials and material combinations are varied as the abrasive coating for the igniter apparatus 102. The material consistency of the abrasive coating is selected to correspond to the type of sensitized tip of the cigarette or other tobacco-based product being ignited and all combinations should be considered incorporated herein. In still other embodiments, the abrasive material is imbedded at the contacting surfaces of the chamber 130 during manufacture of the first member 110 and the second member 112.

The top wall 124 is generally planar on one surface thereof to interface with the generally planar bottom surface of the pack of cigarettes 100. In one embodiment, an adhesive strip 138 is located at a surface of the top wall 124. The adhesive strip may be formed from a plurality of different adhesive materials, including, but not limited to hook and loop fasteners, magnets, double-sided tape and the like. Further, while this particular embodiment illustrates the adhesive strip 138 on the top wall 124, the skilled artisan will understand that the adhesive strip 138, in different embodiments, is placed on other surfaces of the igniting apparatus 102 without straying from the present disclosure. Further, the igniter apparatus 102, in other embodiments, stands alone and is stored separately from the pack of cigarettes 100 if desired. For instance, in a factory where combustible materials are made or stored, the igniter apparatus is located away from the combustible materials and adhered to a smoking station.

The top wall 124 includes retainer 140 which is configured to engage a portion of the first member 110. By engaging the first member 110, the retainer 140 limits movement of the first member 110 with respect to the second member 112, such that the size of the chamber 130 is limited to a maximum size when the projecting portion 114 is located in the receiving portion 116. In one embodiment, the retainer 140 is a tab, which substantially limits the first member 110 from being separated from the second member 112 during normal use.

As described above, one of the first member 110 and second member 112 of lighter assembly 102 is moveable relative to the other of the first member 110 and second member 112. In accordance with this aspect, a top surface 142 (See FIG. 4) of the projecting portion 114 maintains a substantially parallel planar orientation with respect to a bottom surface 143 (See FIG. 3) of the receiving portion 116. In this manner, the size of the chamber 130 is repeatably consistently adjustable when lighting one tobacco-based product after a previously ignited tobacco-based product.

When an external force is applied to bring the first member 110 and the second portion 112 towards one another, a size of a gap 144 (See also FIG. 6) between first member 110 and the second portion 112 is adjusted. When the gap 144 is sufficiently reduced, the distance between the abrasive located on the first concave surface 132 and the second concave surface 134 is reduced sufficiently to contact a tip 146 of the cigarette 106 if located in the chamber 130. Consequently, by: i) inserting the cigarette 106 into the chamber 130; ii) adjusting the gap 144 sufficiently to contact the tip 146; and iii) removing the cigarette 106 from the chamber 130 while reduced in size, the tip 146 ignites and the cigarette 106 is lit. Depending on the amount of external force applied, the gap 130 allows the cigarette 106 with a sensitized tip 146 to be inserted or removed from the chamber 130 with minimal or no contact with the abrasive. As shown, the abrasives 135 at least partially surround the tip 146 of the cigarette 106.

In different embodiments, the chamber 130 includes many different types of shapes, such as a square, oval, triangle, octagon, and the like to provide similar results. Furthermore, in other embodiments, the chamber is an enclosed chamber. For example, the chamber 130 of FIG. 2 does not require a chamber which is entirely enclosed around the perimeter of the cigarette 106. In other embodiments, the chamber 130 includes a substantial gap between each half (first concave surface 132 and second concave surface 134) and still provides sufficient contact with the cigarette tip 146 to be effective.

While the chamber 130 is shaped in any manner to permit the cigarette 106 to be inserted therein, in accordance with certain aspects, the chamber 130 has a substantially cylindrical shape. In accordance with this aspect of the present disclosure, the chamber 130 includes a diameter slightly greater than the diameter of the cigarette 106.

The first member 110 and second member 112, in different embodiments, are constructed of any material sufficient to achieve the disclosed function. Materials including, plastic, metal, wood, composites, and the like are incorporated herein. One skilled in the art can appreciate, without resorting to undue experimentation, that any such materials and compositions could be used to construct the disclosed embodiments. As such, the present teachings are not intended to be limited.

Figure 3:
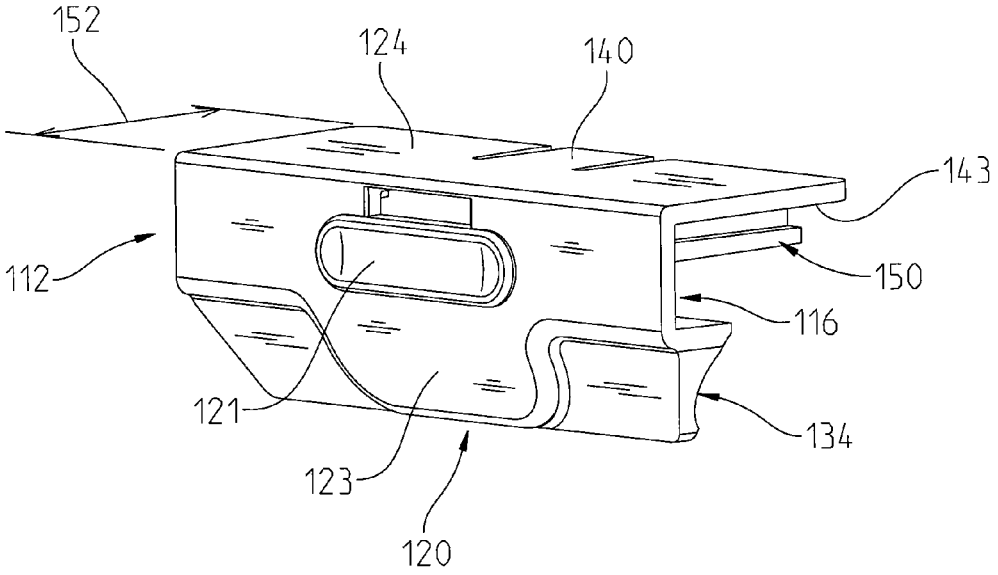
FIG. 3 is a perspective view of one member of the igniter apparatus.

FIG. 3 is a perspective view of the second member 112 including the user accessible surface 120, the top wall 124, and the tab 140. In the illustrated embodiment, one or more ribs 150 are coupled to the top wall 124, each of which extends along a width 152 of the top wall 124. The rib 150, in one embodiment, is coupled to an underneath side of the top wall 124 and generally defines what is known as an "I" beam configuration.

Figure 4:
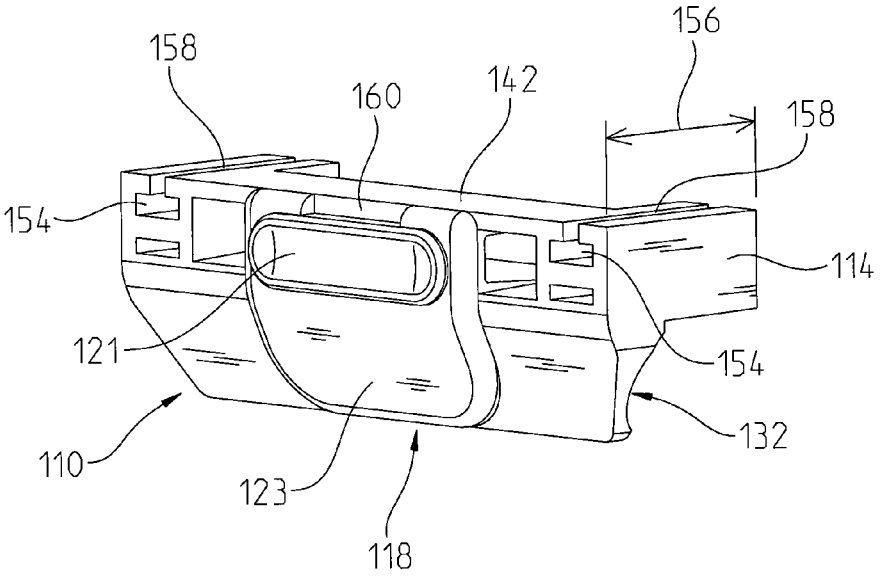
FIG. 4 is a perspective view of another member of the igniter apparatus.

FIG. 4 illustrates a perspective view of the second member 110 which includes one or more cavities 154, each of which is configured to receive one of the ribs 150. The cavity 154 extends along a width 156 of the first member 110 and includes a channel 158 configured to receive the rib 150. The first member 110 further includes a stop 160 defined by an edge of thereof configured to engage the retainer 140 when the first member 110 is located with the second member 112 to form the chamber 130. A rail 162 (See FIG. 5) formed in the retainer 140 contacts the stop 160 to hold the first and second members 110 and 112 together. Movement of the first member 110 with respect to the second member 112 is restricted in at least one direction by the rail 162 in contact with the stop 160.

Figure 5:
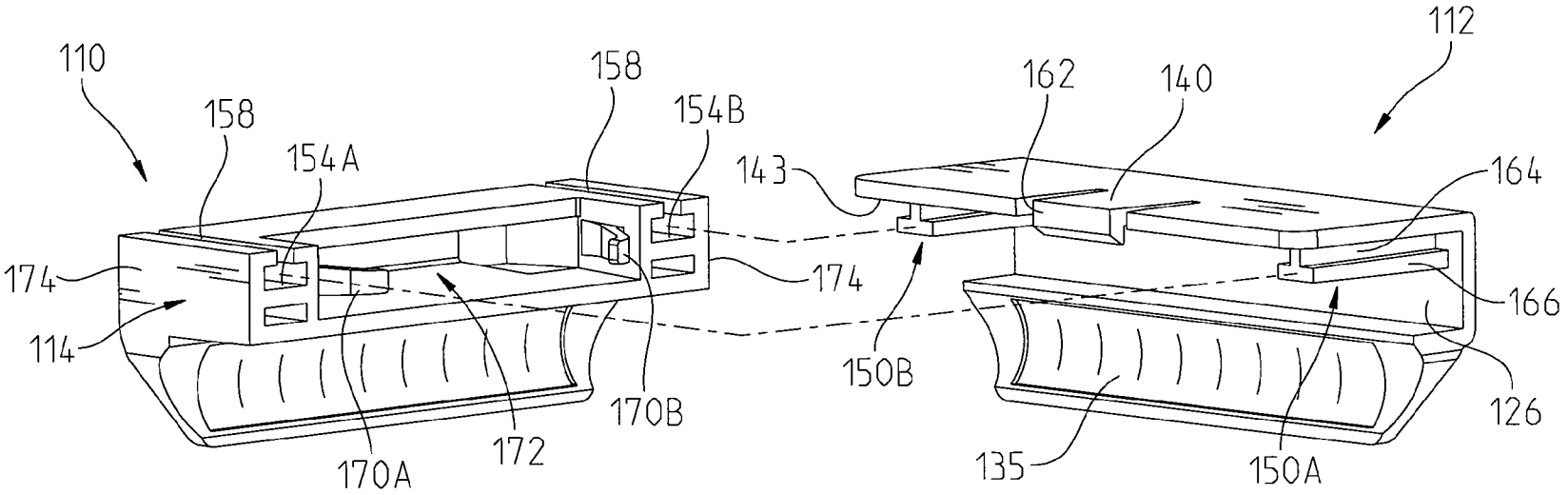
FIG. 5 is an perspective exploded view of two members of the igniter apparatus.

FIG. 5 is an exploded perspective view of the first member 110 and the second member 112 shown in a separated spaced alignment to indicate the engagement of a first rib 150A and a second rib 150B with a first cavity 154A and a second cavity 154B. Each of the ribs 150 slidingly engages one of the cavities 154. Each of the ribs 150 includes a web portion 164 coupled to a flange portion 166. The web portion 166 extends through the channel 158 such that alignment of the first member 110 to the second member 112 is maintained during relative movement thereof. Consequently, the space defined by the chamber 130 during ignition of a tobacco-based product is repeatably consistently sized from one tobacco-based product to the next.

FIG. 5 further illustrates a first bias element 170A and a second bias element 170B, each of which extends laterally into a space 172 from side portions 174 of the projecting portion 114. Each of the bias elements 170 also extends past a plane defined by the front surface of each of the side portions 174, such that the bias elements 170 contact or engage the back wall 126 of the second member 112 when the members 110 and 112 are combined as a single unit.

Figure 6:
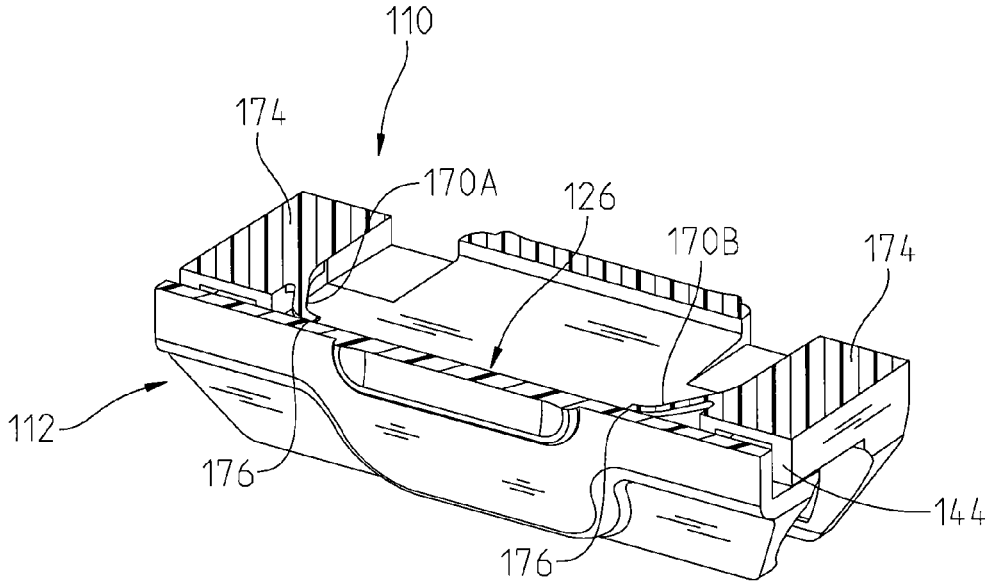
FIG. 6 is a cross-sectional perspective view of the igniter apparatus taken along a line 6-6 of FIG. 1.

As seen in FIG. 6, each of the bias elements 170 are formed as a single unitary part integrally formed with one of the corresponding side portions 174. Each of the bias elements 170 are formed to curve inwardly into the space 172 and include ends 176 which are configured to contact the back wall 126 of the second member 112. In addition, each of the bias elements 176 are formed to be flexible and resilient, such that the relative movement of the first member 110 with the second member 112 to decrease the size of the gap 144 increases the tension placed on each of the bias elements 170. The first member 110 and second member 112 are therefore biased at a first position with the bias elements 170 and movement of the first member 110 toward the second member 112 compresses the bias elements 170, reduces the size of the chamber 130, and thereby decreases the distance between the abrasives 135 located at the sides of the chamber. Insertion of the tobacco based product in the first position locates the sensitized tip adjacent to the abrasives. Compression of the bias elements 170 reduces the size of the chamber such that the sensitized tip contacts the abrasive. Removal of the tobacco-based product from the reduced-in-size chamber ignites the sensitized tip, thereby lighting the tobacco-based product for smoking. Consequently, the act of igniting the tip 146 requires that the user positively move the first member 110 and second member 112 closer together to contact the tip 146. Movement of the tip 146 along the abrasives lights the cigarette. Once lit, the user reduces the pressure applied to the igniter apparatus 102, the bias elements 170 increase the size of the gap 144 and therefore the size of the chamber 130, to thereby enable removal of a lit product without damage to the product.

Each of the first member 110 and the second member 112, in one embodiment, are formed as a single unitary part. By forming the bias elements as a part of the unitary first member 110, the number of parts required to complete the igniter apparatus 102 is reduced, thereby reducing manufacturing costs and reducing the complexity of assembling a final igniter apparatus 102. Additionally, the manufacture of a single unitary part, in one embodiment, is provided by injection molding of each of the first member 110 and the second member 112. The use of such a manufacturing technique provides for consistent and repeatable manufacture of parts in large quantities, if desired, without reducing the effectiveness of the igniter apparatus 102. Other methods of molding are also used in different embodiments. Other embodiments include having one of or both of the first member 110 and the second member 112 formed of more than one part. In one embodiment, for instance, the bias elements 170 are formed separately from the formation of the first member 110 and inserted into holes or apertures configured to receive the bias elements 170.

Figure 7:
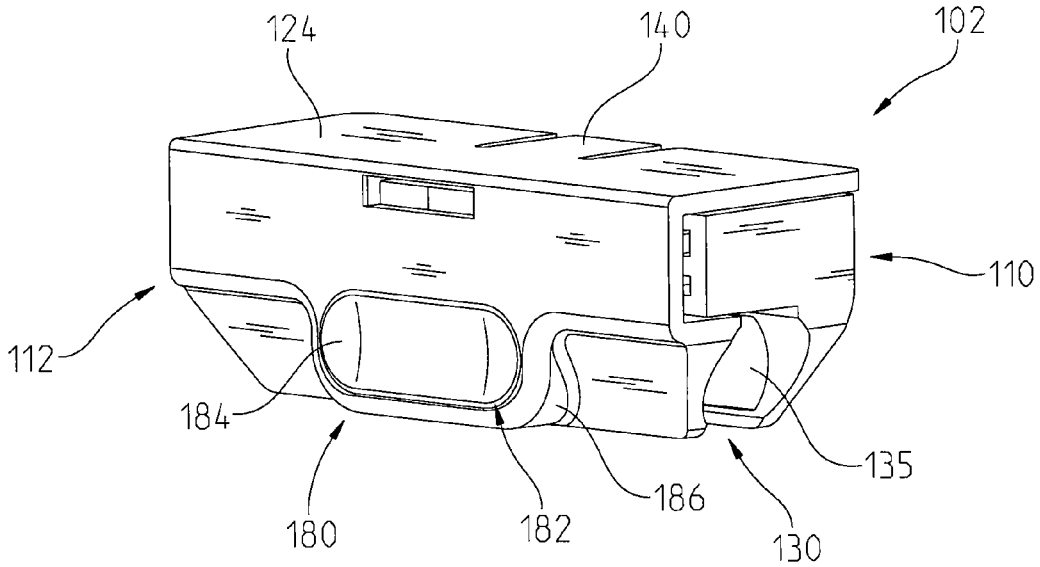
FIG. 7 is a perspective view of another embodiment of an igniter apparatus.

FIG. 7 illustrates another embodiment of the igniter apparatus 102. While the first member 110 is the same as previously described, the second member 112 includes a user accessible surface 180. In this embodiment, a tactile interface 182 defined by raised edges when compared to a recessed surface 184 is provided to direct an application of force by a user's hand, and in particular a user's fingers at the defined location. In this embodiment, the tactile interface 182 is spaced from the top surface 124 such that the interface 182 is lower, i.e. closer to the bottom of the igniter assembly 102, than in the other embodiment. In addition, the tactile interface 182 does not slope toward the chamber 130, but instead is relatively perpendicular to the top wall 124. To provide this location of the tactile interface 182, the second member 112 includes a spacing portion 186 upon which the tactile interface is formed, as seen in both FIGS. 7 and 8.

Figure 8:
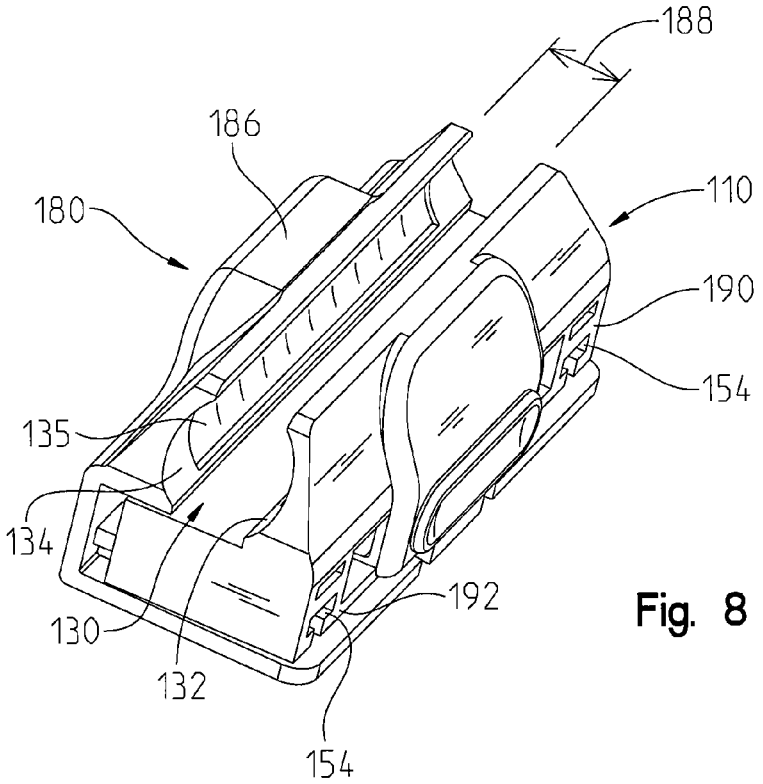
FIG. 8 is a bottom perspective view of the igniter apparatus of FIG. 7.

FIG. 8 illustrates the igniter apparatus 102 in an inverted position to more fully depict the chamber 130. As can be seen, the second concave surface 134 supports the abrasive. While not shown, the first concave surface 132 supports a similarly situated abrasive. In one embodiment, a gap 188 is defined between the terminating ends of the first and second concave surfaces 132 and 134. This gap 188 includes a width in the opened position which is larger than a diameter of the tobacco-based product being ignited. Consequently, during an igniting operation, the cigarette is moved into the chamber 130 by moving the cigarette through the gap first, as opposed to inserting the cigarette through one of the ends of the chamber. In other embodiments, the gap 188 is less than the diameter of the tobacco-based product, such that the cigarette is inserted into one of the ends of the chamber 130.

While not shown in the igniter apparatus 102 of FIGS. 2 and 8, a cover, in different embodiments, is located on a surface 190 and a surface 192 of the first member 110. The cover includes a first piece and a second piece to respectively cover the exposed apertures seen in each of the figures. The cover substantially prevents debris or other unwanted material collecting in the cavities 154, for instance, which could restrict movement of one member with respect to the other member. Additionally, the cover includes a surface, which in different embodiments, is utilized for logos, advertising, or other indicia.

While one or more exemplary embodiments incorporating the principles of the present application have been disclosed hereinabove, the present application is not limited to the disclosed embodiments. Instead, this application is intended to cover any variations, uses, or adaptations of the application using its general principles. Further, this application is intended to cover such departures from the present disclosure as come within known or customary practice in the art to which this present application pertains and which fall within the limits of the appended claims.

The terminology used herein is for the purpose of describing particular illustrative embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations).

The invention claimed is:

1. An igniter apparatus for igniting a tobacco-based product having a sensitized tip, comprising: a first member including a projecting portion having a cavity and a first concave surface disposed adjacent to the projecting portion; a second member including a rib, a receiving portion configured to receive the projecting portion, and a second concave surface disposed adjacent to the receiving portion, wherein the cavity is configured to receive the rib and the first concave surface and the second concave surface define a chamber configured to receive the tobacco-based product when the projecting portion is located in the receiving portion and the rib is disposed in the cavity, wherein at least one of the first concave surface and the second concave surface supports an abrasive.

2. The igniter apparatus of claim 1 wherein the projecting portion slidingly fits in the receiving portion and the rib slidingly fits in the cavity, wherein sliding movement between the first member and the second member changes the size of the chamber.

3. The igniter apparatus of claim 2 further comprising a bias element extending between the first member and the second member wherein movement of the first member with the second member compresses the bias element.

4. The igniter apparatus of claim 3 wherein the bias element is formed as a part of one of the first member and the second member.

5. The igniter apparatus of claim 4 wherein one of the first member and the second member includes a retainer configured to engage the other of the first portion and the second portion, wherein the retainer is configured maintain the location of the first portion with respect to the second portion in at least one direction.

6. The igniter apparatus of claim 5 wherein at least one of the first member and the second member includes an exterior area configured to provide a tactile interface between the exterior area and a hand of a user of the igniter apparatus.

7. The igniter apparatus of claim 6 wherein each of the first member and the second member includes respectively a first exterior area and a second exterior area each including a surface angled with respect to the other surface.

8. The igniter apparatus of claim 7 wherein one of the first member and the second member includes a coupler configured to couple the igniter apparatus to a container holding a tobacco-based product.

9. The igniter apparatus of claim 8 wherein the second member includes the coupler and the coupler includes an adhesive.

* * * * *